US011739638B2

(12) United States Patent
Song et al.

(10) Patent No.: US 11,739,638 B2
(45) Date of Patent: Aug. 29, 2023

(54) TRAVELLING-TYPE TUNNEL HARD-ROCK MICRO-DAMAGE CUTTING EQUIPMENT AND CONSTRUCTION METHOD ASSOCIATED THEREWITH

(71) Applicant: SHANDONG JIANZHU UNIVERSITY, Jinan (CN)

(72) Inventors: Shuguang Song, Jinan (CN); Huibin Sun, Jinan (CN); Can Xie, Jinan (CN); Jiancai Wang, Liaocheng (CN); Wei Dong, Linyi (CN); Xin Miao, Jinan (CN); Zhenfeng Guo, Jinan (CN)

(73) Assignee: SHANDONG JIANZHU UNIVERSITY, Jinan (CN)

( * ) Notice: Subject to any disclaimer, the term of this patent is extended or adjusted under 35 U.S.C. 154(b) by 0 days.

(21) Appl. No.: 17/474,340

(22) Filed: Sep. 14, 2021

(65) Prior Publication Data

US 2022/0235658 A1 Jul. 28, 2022

(30) Foreign Application Priority Data

Jan. 25, 2021 (CN) ..... 202110098490.3

(51) Int. Cl.
*E21D 9/10* (2006.01)

(52) U.S. Cl.
CPC ..... *E21D 9/1093* (2013.01); *E21D 9/102* (2013.01)

(58) Field of Classification Search
CPC ..... E21C 37/04; E21C 37/08; E21D 9/102; E21D 9/1093
See application file for complete search history.

(56) References Cited

U.S. PATENT DOCUMENTS 396,719 A * 1/1889 Watkins ..... E21C 37/04 299/22
2,581,667 A * 1/1952 Joy ..... E21C 37/10 175/323
2,634,114 A * 4/1953 Joy ..... E21C 37/08 166/89.1

(Continued)

FOREIGN PATENT DOCUMENTS

CN 110486007 A * 11/2019

*Primary Examiner* — Janine M Kreck
(74) *Attorney, Agent, or Firm* — WPAT, PC

(57) ABSTRACT

A travelling-type tunnel hard-rock micro-damage cutting equipment and a construction method associated therewith are provided. The cutting equipment includes: a crawler-type trolley; and a hard-rock drilling construction apparatus, a hard-rock cutting construction apparatus, a self-unloading tipping bucket and a visual operation terminal all arranged on the crawler-type trolley. The hard-rock cutting construction apparatus includes: a cutting manipulation room, a rock-breaking power arm, and a hard-rock cutting device including a hydraulic steel robs, a signal sensor, an infrared lens and a light source assembly. The infrared lens and the light source assembly are arranged at the front end of the hard-rock cutting device, and a working image can be transmitted to the visual operation terminal through the signal sensor. The cutting equipment can accurately and efficiently cut a rock mass, and the cut rock mass can be reused according to secondary processing conditions of rock to improve economic benefits.

5 Claims, 2 Drawing Sheets

(56) References Cited

U.S. PATENT DOCUMENTS

| | | | | |
|---|---|---|---|---|
| 4,363,519 | A * | 12/1982 | Howard | E21C 27/28<br>173/27 |
| 2001/0039712 | A1* | 11/2001 | Ruehl | B62D 21/02<br>29/469 |
| 2014/0313502 | A1* | 10/2014 | Steele | E21B 7/022<br>356/4.01 |
| 2015/0204149 | A1* | 7/2015 | O'Reilly | E21B 19/24<br>175/45 |

* cited by examiner

TRAVELLING-TYPE TUNNEL HARD-ROCK MICRO-DAMAGE CUTTING EQUIPMENT AND CONSTRUCTION METHOD ASSOCIATED THEREWITH

TECHNICAL FIELD

The invention relates to the field of underground engineering constructions, and more particularly to a travelling-type tunnel hard-rock micro-damage cutting equipment and a construction method associated therewith.

DESCRIPTION OF RELATED ART

In recent years, Chinese transportation industry has developed rapidly, and traditional automobile travels have been unable to meet speed needs of people. Therefore, the state proposes to take the lead in building a modern railway network by 2035, including about 70,000 kilometers of high-speed railways. In the construction of high-speed railways in mountainous areas, the construction of tunnels often accounts for the largest proportion of the entire project. Accordingly, excavation speeds and construction quality of tunnels directly affect social and economic benefits brought by high-speed railways.

At present, in constructions of hard-rock tunnels in China, blasting is usually used for excavation in areas with good geological conditions. The blasting is accompanied by a large number of rocks being broken/crushed to separate them from the parent rock. Rocks crushing means that their utilization rates will be greatly reduced, and meanwhile the treatment of crushed rocks will increase the project cost. The traditional blasting method has problems such as large vibration, crushed rocks splashing and dust pollution, which seriously affects the safety of construction personnel and is not conducive to environmental protection. Moreover, the removal of drilling and other equipment before the blasting would affect the construction efficiency. Blasting for excavation in areas with poor geological conditions can easily lead to engineering accidents such as collapse, roof fall and rock burst, resulting in a large number of property damage and casualties.

In addition, researchers have little research and development on travelling-type tunnel hard-rock micro-damage cutting equipment, and thus there is no complete set of tunnel hard-rock integrity excavation equipment. Therefore, there is an urgent need for a travelling-type/walking-type hard-rock micro-damage cutting equipment and a construction method associated therewith in the aspect of tunnel excavation construction. Researches in such aspect can provide tools for tunnel excavation construction, and have good engineering value and market prospects.

SUMMARY

An objective of the invention is to overcome the above-mentioned shortcomings in the related art. In order to achieve the objective, the invention aims to provide tunnel excavation construction equipment and method that have high degree of mechanization, good rock integrity, and easy support. The invention may guarantee green and environmental protection while ensuring high excavation efficiency.

Specifically, an embodiment of the invention provides a travelling-type tunnel hard-rock micro-damage cutting equipment including: a crawler-type trolley, a hard-rock drilling construction apparatus, a hard-rock cutting construction apparatus, a self-unloading tipping bucket, and a visual operation terminal. The hard-rock drilling construction apparatus, the hard-rock cutting construction apparatus, the self-unloading tipping bucket, and the visual operation terminal are arranged on the crawler-type trolley. The hard-rock drilling construction apparatus includes a drilling manipulation room, a drilling power arm, and a detachable drilling device. The hard-rock cutting construction apparatus includes a cutting manipulation room, a rock-breaking power arm, and a hard-rock cutting device.

In an embodiment, the drilling power arm and the rock-breaking power am are hinged to the crawler-type trolley for connection, and thereby realizing height changes of the drilling device and the hard-rock cutting device through expansion and contraction of oil cylinders.

In an embodiment, the detachable drilling device includes a laser positioner/locator, a driller, and a ruler; the laser locator is connected to a top portion of the driller by a screw bolt, and the ruler is located at a front end of the drilling power arm.

In an embodiment, the drilling manipulation room and the cutting manipulation room are equipped with vibration-absorbing rubber layers there-below, to increase the manipulation comfort of an operator.

In an embodiment, the hard-rock cutting device includes hydraulic steel rods, a signal sensor, an infrared lens, and a light source assembly. The infrared lens and the light source assembly are arranged at a front end of the hard-rock cutting device, and a working image is transmitted to the visual operation terminal through the signal sensor. The hydraulic steel rods are twenty in number/amount, and the twenty hydraulic steel rods are arranged around (e.g., four sides of) the hard-rock cutting device.

In another aspect, a tunnel construction method based on the travelling-type tunnel hard-rock micro-damage cutting equipment according to an embodiment of the invention includes the following steps:

(1) preliminary preparation operation: detecting rock mass information including integrity and nature of a rock mass before (the travelling-type tunnel hard-rock micro-damage cutting equipment) entering a tunnel for working, starting the crawler-type trolley and checking (various properties of) the hard-rock drilling construction apparatus and the hard-rock cutting construction apparatus;

(2) drilling position determination: determining appropriate drilling locations and depth according to the detected rock mass information and secondary processing information of rock, after manipulating the crawler-type trolley to enter a predetermined working area of the tunnel;

(3) drilling operation: firstly adjusting the driller according to the drilling depth by an operator, then controlling the drilling power arm through the drilling manipulation room to drill around a surrounding rock to demarcate a whole rock mass to-be-cut from the surrounding rock, and subsequently performing a drilling on the drilling locations according to use needs of rock;

(4) rock-breaking and cutting position adjustment: the hard-rock drilling construction apparatus being terminated working after the drilling operation is completed; and in a manner of no need of turning, controlling the rock-breaking power arm through the cutting manipulation room by the operator to make the hard-rock cutting construction apparatus be aligned with a drilled hole;

(5) transversal cutting operation: firstly deepening the hard-rock cutting device into the drilled hole by the operator and turning on an illumination switch on the visual operation terminal during the deepening for observation of positions of transversal hydraulic steel rods via a display on the visual operation terminal to ensure the transversal hydraulic steel rods accurately reach a working position, then activating the transversal hydraulic steel rods through the visual operation terminal to perform a hard-rock cutting, and turning on an infrared switch on the visual operation terminal for auxiliary observation when observation effect for the hard-rock cutting is poor (i.e., not good);

(6) longitudinal cutting operation: performing a longitudinal cutting operation according to a project need after the transversal cutting operation is completed, specifically by closing the transversal hydraulic steel rods through the visual operation terminal and opening longitudinal hydraulic steel rods through the signal sensor; and (7) transportation operation: replacing the detachable drilling device with a five-claw hook after the cutting operations are completed, turning the crawler-type trolley equipped with the self-unloading tipping bucket in situ, hoisting cut rocks to the self-unloading tipping bucket by the five-claw hook and then being transported out of the tunnel with the crawler-type trolley, and carrying out a lining construction in time on the cut rock mass.

Sum up, the invention can achieve beneficial effects as follows.

(i) The crawler-type trolley of an embodiment of the invention is provided with both the hard-rock drilling construction apparatus and the hard-rock cutting construction apparatus, the operator can control the drilling power arm through the drilling manipulation room to perform the drilling operation, and can directly control the equipment to perform hard-rock cutting operations after the drilling operation is completed. After the cutting operations are completed, the detachable drilling device can be replaced with the five-claw hook and the crawler-type trolley equipped with the self-unloading tipping bucket is turned in situ, and the cut rocks are lifted/hoisted by the five-claw hook to the self-unloading tipping bucket. After the hoisting of cut rocks is completed, the cut rocks will be transported out of the tunnel with the crawler-type trolley. The whole work is done in one go, no need to repeatedly replace or build equipment platforms.

(ii) The front end of the drilling power arm of an embodiment of the invention may be equipped with the ruler, the operator can accurately understand/acquire the drilling depth by observing the scale of the ruler, so that the cutting of rock realizes "individualized" customization in size, and it is convenient for subsequent direct use and thereby increases the added value.

(iii) The hard-rock drilling construction apparatus and the hard-rock cutting construction apparatus of an embodiment of the invention both may be supported by power arms, and thus positions of the drilling device and the hard-rock cutting device can be flexibly adjusted through hydraulic oil cylinders. Vibration-absorbing rubber layers may be placed under the drilling manipulation room and the cutting manipulation room to ensure that the equipment does not resonate with a bearing plate of the crawler-type trolley under continuous operation, thereby avoiding other noises other than the sound of working, and increasing the manipulation comfort of the operator.

(iv) The infrared lens and light source assembly of an embodiment of the invention may be arranged at the front end of the hard-rock cutting device, and the working image can be transmitted to the visual operation terminal through a signal sensor. The hydraulic steel rods may be 20 in number/quantity, and respectively located around the hard-rock cutting device, so as to improve cutting efficiency.

(v) The hard-rock cutting device of an embodiment of the invention can cut the rock mass into customized sizes and shapes, and thus the cut rocks can be directly used in other engineering constructions or for secondary development; as to high-quality natural stones, the market demand is large and the economic added value is higher.

Figure 1A:
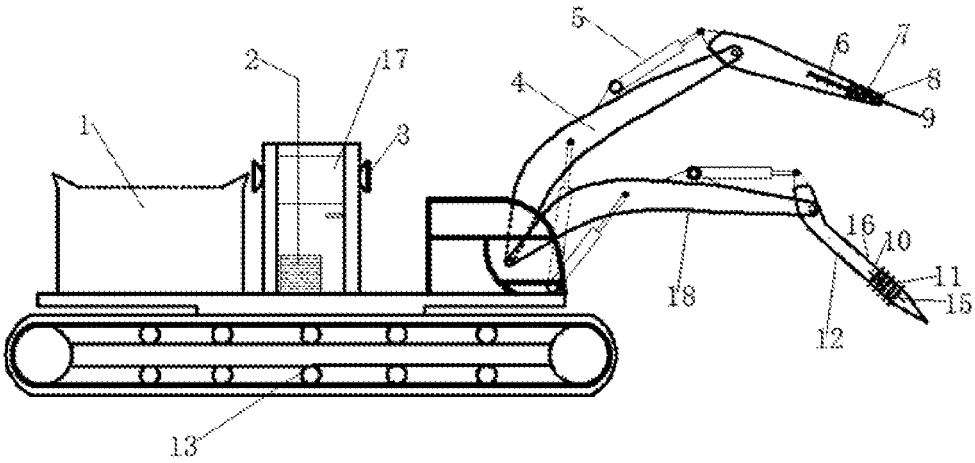
FIG. 1A and FIG. 1B are schematic views of a travelling-type tunnel hard-rock micro-damage cutting equipment in different states according to the invention.
Figure 1B:
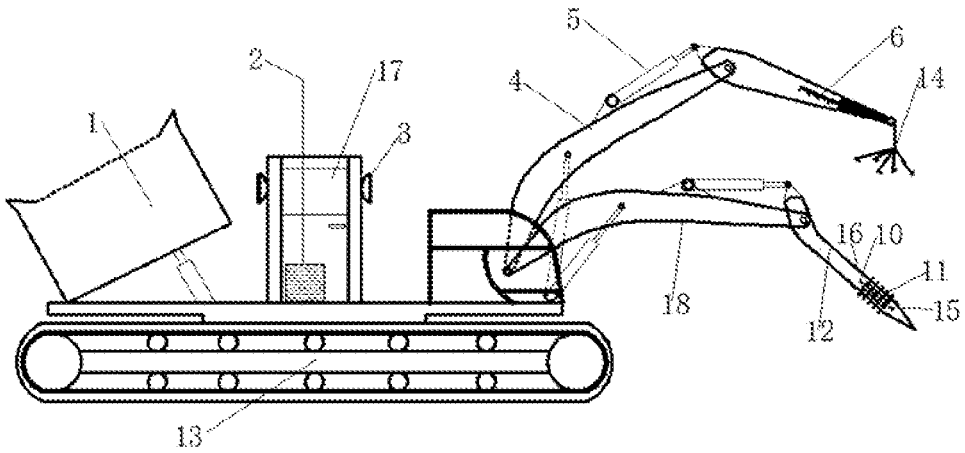
Figure 2:
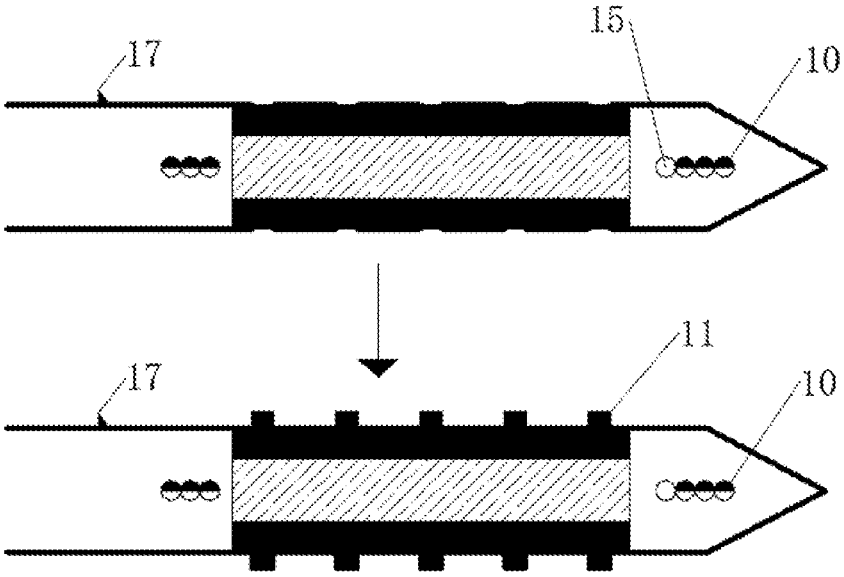
FIG. 2 is a schematic view of a hard-rock cutting device according to the invention.
Figure 3A:
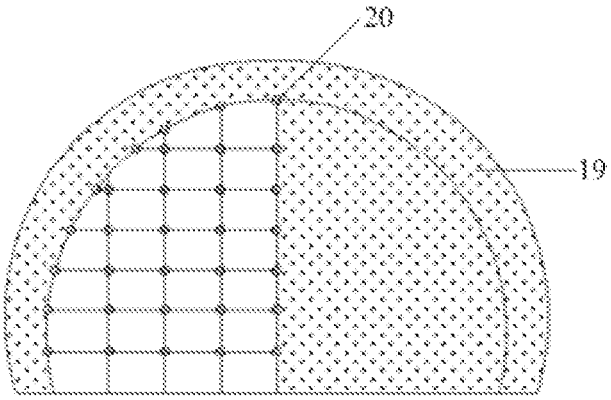
FIG. 3A and FIG. 3B are schematic views associated with a working of the travelling-type tunnel hard-rock micro-damage cutting equipment, showing a cut rock mass and a surrounding rock at different views.
Figure 3B:
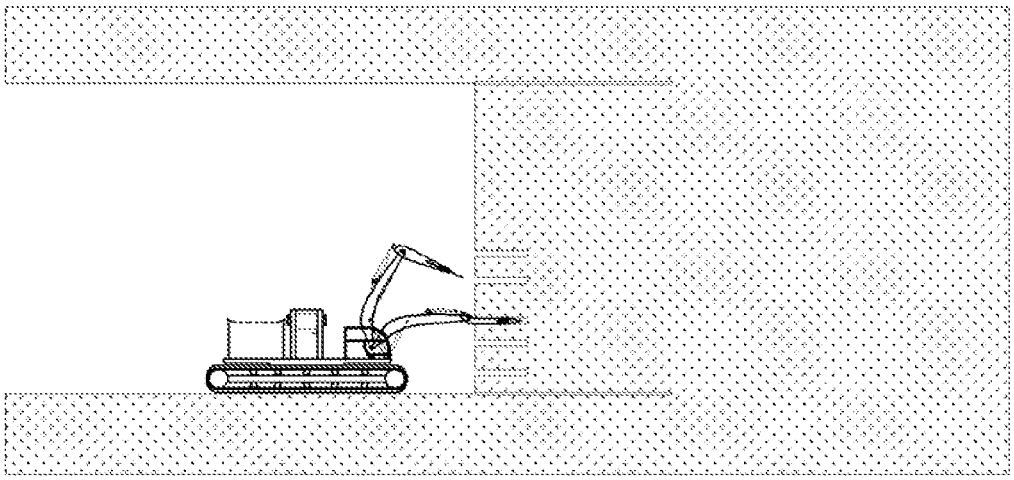

Reference numerals: 1, self-unloading tipping bucket; 2, visual operation terminal; 3, lookout window; 4, drilling power arm; 5. hydraulic oil cylinder; 6, ruler; 7, detachable drilling device; 8, laser locator; 9, driller; 10, light source assembly; 11, hydraulic steed rod; 12, hard-rock cutting device; 13, crawler-type trolley; 14, five-claw hook; 15, infrared lens; 16, signal sensor; 17, manipulation cab; 18, rock-breaking power arm; 19, surrounding rock; 20, drilled hole.

DETAILED DESCRIPTION OF EMBODIMENTS

Embodiments of the invention provide a travelling-type tunnel hard-rock micro-damage cutting equipment and a construction method associated therewith. The method may include the following step 1 through step 7.

Step 1, preliminary preparation operation: rock mass information including integrity and nature of a rock mass is detected before (the travelling-type tunnel hard-rock micro-damage cutting equipment) entering a tunnel for working, the crawler-type trolley 13 then is started and various properties of the hard-rock drilling construction apparatus and the hard-rock cutting construction apparatus are checked.

Step 2, drilling position determination: appropriate drilling locations and depth are determined according to the preliminary detected rock mass information and secondary processing information of rock, after manipulating the crawler-type trolley 13 to enter a predetermined working area of the tunnel.

Step 3, drilling operation: firstly the driller 9 is adjusted by an operator according to the drilling depth, the drilling power arm 4 then is controlled through the manipulation cab 17 (drilling manipulation room) to drill holes around a surrounding rock 19 to demarcate a whole rock mass to-be-cut from the surrounding rock 19, and subsequently a drilling is performed on the drilling locations according to use needs of rock.

Step 4, rock-breaking and cutting position adjustment: the hard-rock drilling construction apparatus is terminated working after the drilling operation is completed; and in the manner of no need of turning, the rock-breaking power arm 18 then is controlled through the manipulation cab 17 (cutting manipulation room) by the operator to make the hard-rock cutting construction apparatus be aligned with a drilled hole 20.

Step 5, transversal cutting operation: firstly the hard-rock cutting device 12 is deepened into the drilled hole 20 by the operator, and during the deepening, an illumination switch on the visual operation terminal 2 is turned on and positions of transversal hydraulic steel rods 11 are observed via a display on the visual operation terminal to ensure the transversal hydraulic steel rods accurately reach a working position, then the transversal hydraulic steel rods 11 are activated through the visual operation terminal 2 to perform a hard-rock cutting, and an infrared switch on the visual operation terminal is turned on for auxiliary observation when observation effect for the hard-rock cutting is poor (i.e., not good).

Step 6, longitudinal cutting operation: a longitudinal cutting operation is performed according to a project need after the transversal cutting operation is completed, and specifically the transversal hydraulic steel rods 11 are closed through the visual operation terminal 2 and longitudinal hydraulic steel rods 11 are opened through the signal sensor 16, to continue performing the working of cutting.

Step 7, transportation operation: the detachable drilling device 7 is replaced with a five-claw hook 14 after the (transversal and longitudinal) cutting operations are completed, the crawler-type trolley 13 equipped with the self-unloading tipping bucket 1 is turned in situ, cut rocks is hoisted/lifted to the self-unloading tipping bucket 1 by the five-claw hook 14 and then transported out of the tunnel with the crawler-type trolley 13, and a lining construction is carried out in time on the cut rock mass.

Although the foregoing description describes specific embodiments of the invention with reference to the accompanying drawings, it is not intended to limit the scope of protection of the invention. Those skilled in the art should understand that on the basis of the described technical solutions of the invention, various modifications or deformations that can be made by those skilled in the art without creative effect are still within the protection scope of the invention.

What is claimed is:

1. A travelling-type tunnel hard-rock micro-damage cutting equipment, comprising: a crawler-type trolley, a hard-rock drilling construction apparatus, a hard-rock cutting construction apparatus, a self-unloading tipping bucket, and a visual operation terminal;

wherein the hard-rock drilling construction apparatus, the hard-rock cutting construction apparatus, the self-unloading tipping bucket, and the visual operation terminal are arranged on the crawler-type trolley;

wherein the hard-rock drilling construction apparatus comprises a drilling power arm and a detachable drilling device; and wherein the hard-rock cutting construction apparatus comprises a rock-breaking power arm and a hard-rock cutting device;

wherein the hard-rock cutting device comprises hydraulic steel rods, a signal sensor, an infrared lens, and a light source assembly; the infrared lens and the light source assembly are arranged at a front end of the hard-rock cutting device; the light source assembly is configured to transmit light for illuminating a to-be-cut rock; the infrared lens is configured to obtain a working image corresponding to the to-be-cut rock; and the signal sensor is configured to transmit the working image to the visual operation terminal.

2. The travelling-type tunnel hard-rock micro-damage cutting equipment as claimed in claim 1, wherein the drilling power arm and the rock-breaking power arm are hinged to the crawler-type trolley for connection, and thereby realizing height changes of the detachable drilling device and the hard-rock cutting device through expansion and contraction of oil cylinders.

3. The travelling-type tunnel hard-rock micro-damage cutting equipment as claimed in claim 1, wherein the detachable drilling device comprises a laser locator, a driller, and a ruler; the laser locator is connected to a top portion of the driller through a screw bolt, and the ruler is arranged at a front end of the drilling power arm.

4. The travelling-type tunnel hard-rock micro-damage cutting equipment as claimed in claim 1, wherein the hydraulic steel rods are twenty in number, and the twenty hydraulic steel rods are arranged around the hard-rock cutting device.

5. The travelling-type tunnel hard-rock micro-damage cutting equipment as claimed in claim 1, further comprising a five-claw hook, wherein the five-claw hook is configured to: replace the detachable drilling device, after a cutting operation on the to-be-cut rock is completed; and hoist cut rock to the self-unloading tipping bucket; and wherein the crawler-type trolley is configured to turn in situ to make the self-unloading tipping bucket and the five-claw hook locate at the same side of the crawler-type trolley.

* * * * *